US007988530B2

(12) United States Patent
Oishi et al.

(10) Patent No.: US 7,988,530 B2
(45) Date of Patent: Aug. 2, 2011

(54) SLICING METHOD

(75) Inventors: Hiroshi Oishi, Nishishirakawa (JP); Daisuke Nakamata, Chikuma (JP)

(73) Assignee: Shin-Etsu Handotai Co., Ltd., Tokyo (JP)

( * ) Notice: Subject to any disclaimer, the term of this patent is extended or adjusted under 35 U.S.C. 154(b) by 338 days.

(21) Appl. No.: 12/310,650

(22) PCT Filed: Aug. 8, 2007

(86) PCT No.: PCT/JP2007/065502

§ 371 (c)(1),
(2), (4) Date: Mar. 3, 2009

(87) PCT Pub. No.: WO2008/035513

PCT Pub. Date: Mar. 27, 2008

(65) Prior Publication Data

US 2009/0253352 A1 Oct. 8, 2009

(30) Foreign Application Priority Data

Sep. 22, 2006 (JP) ..... 2006-257386

(51) Int. Cl.
*B24B 49/14* (2006.01)

(52) U.S. Cl. ..... 451/7; 451/53; 125/16.02

(58) Field of Classification Search ..... 451/7, 53, 451/488, 55, 168; 125/16.02, 21
See application file for complete search history.

(56) References Cited

U.S. PATENT DOCUMENTS

| | | | | |
|---|---|---|---|---|
| 5,269,285 | A * | 12/1993 | Toyama et al. | 125/16.01 |
| 6,443,143 | B1 * | 9/2002 | Ishida et al. | 125/16.02 |
| 6,652,356 | B1 | 11/2003 | Ariga | |
| 6,773,333 | B2 | 8/2004 | Lundt et al. | |
| 7,878,883 | B2 * | 2/2011 | Gupta et al. | 451/7 |
| 2002/0115390 | A1 * | 8/2002 | Kondo et al. | 451/49 |
| 2010/0037881 | A1 * | 2/2010 | Oishi et al. | 125/21 |

FOREIGN PATENT DOCUMENTS

| | | |
|---|---|---|
| JP | A 9-262826 | 10/1997 |
| JP | A 2003-1624 | 1/2003 |
| WO | WO 00/43162 A1 | 7/2000 |

* cited by examiner

*Primary Examiner* — Robert Rose
(74) *Attorney, Agent, or Firm* — Oliff & Berridge, PLC

(57) ABSTRACT

The present invention provides a slicing method comprising winding a wire around a plurality of grooved rollers and pressing the wire against an ingot to be sliced into wafers while supplying a slurry for slicing to the grooved rollers and causing the wire to travel, wherein a cooling speed of the ingot when a slicing depth is equal to or above ⅔ of a diameter is controlled to perform slicing by supplying a slurry for adjusting an ingot temperature to the ingot independently from the slurry for slicing while controlling a supply temperature only in a period from the moment that the slicing depth of the ingot reaches at least ⅔ of the diameter to end of slicing. As a result, the slicing method is provided, in which rapid cooling of the ingot in the time close to end of slicing the ingot can be alleviated when a wire saw is used to slice the ingot, and generation of a nano-topography can be thereby suppressed and further high quality wafers having a uniform thickness are obtained by slicing.

3 Claims, 17 Drawing Sheets

FIG.2
(A)
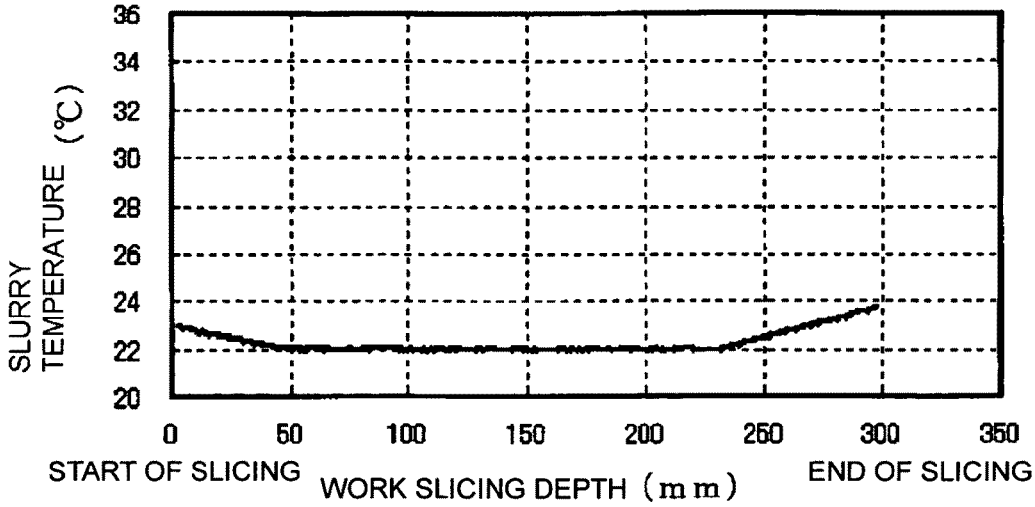
(B)
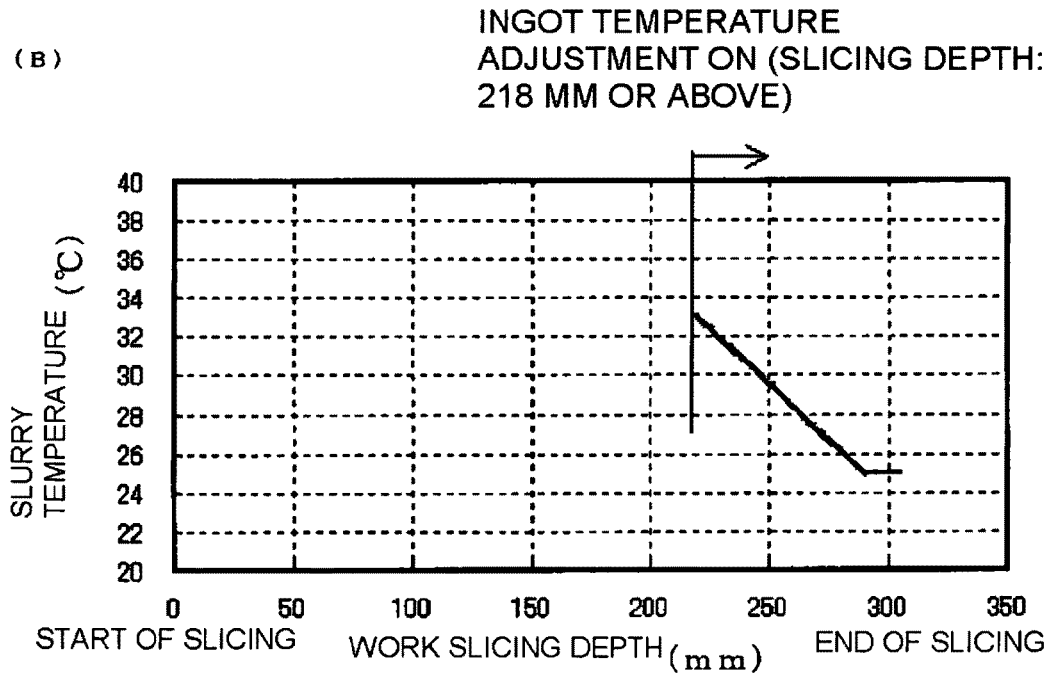

FIG.5
(A)
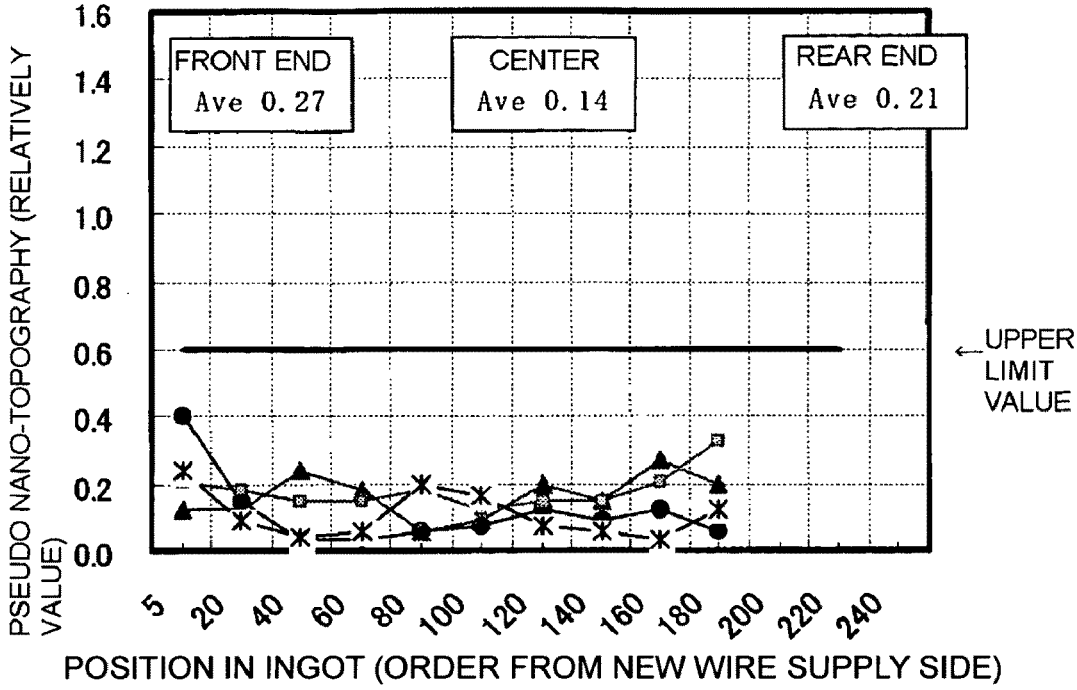
(B)
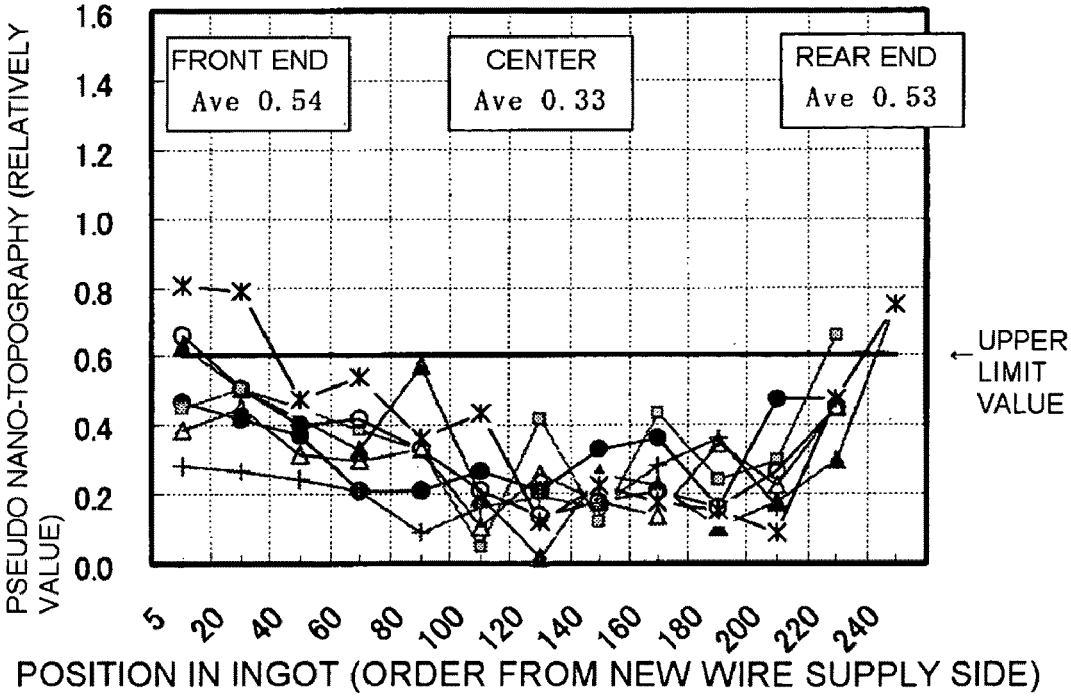

FIG.8

| | | | |
|---|---|---|---|
| CONFOR-MATION | EXTEMPORANEOUS GENERATION 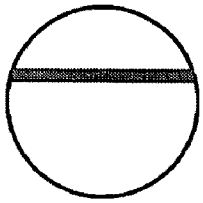 | GENERATION AT SLICING START/SLICING END PORTION 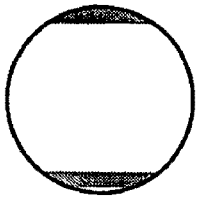 | WAVINESS HAVING PERIODICITY 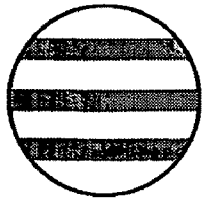 |
| CHARA-CTERIS-TICS | | · HIGH PERCENTAGE OF REJECTION IN NANO-TOPOGRAPHY NUMERIC JUDGMENT | · BECOMING PROBLEM IN SENSORY TEST WHOLLY |
| CAUSE | · WIRE DISCONNECTION<br>· ORIGINATION FROM WIRE (LOT DEFECT)<br>· CONTROL DEFECT OF WIRE SAW APPARATUS | · PRECIPITOUS THERMAL EXPANSION/CONTRACTION OF WORK<br>· SUDDEN CHANGE IN SLICING RESISTANCE | · WORK FEED STRAIGHTNESS DEFECT |

FIG.11
(A)
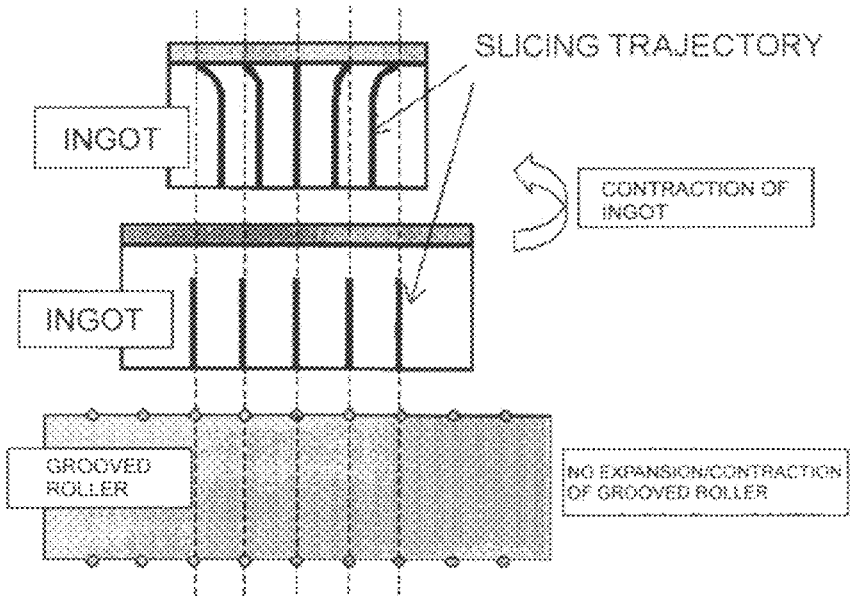
(B)
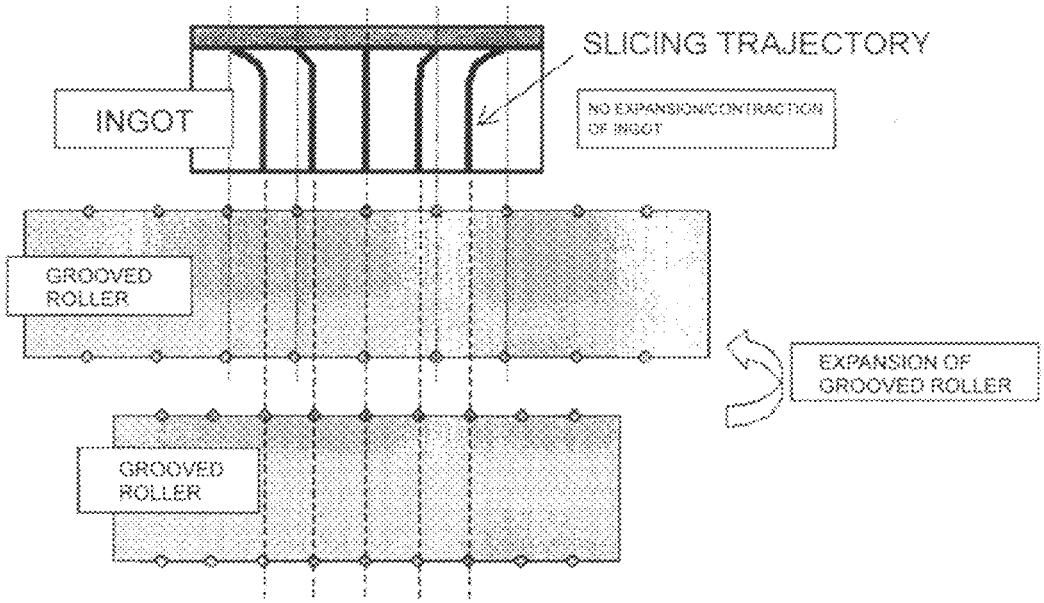

FIG.12
(A)
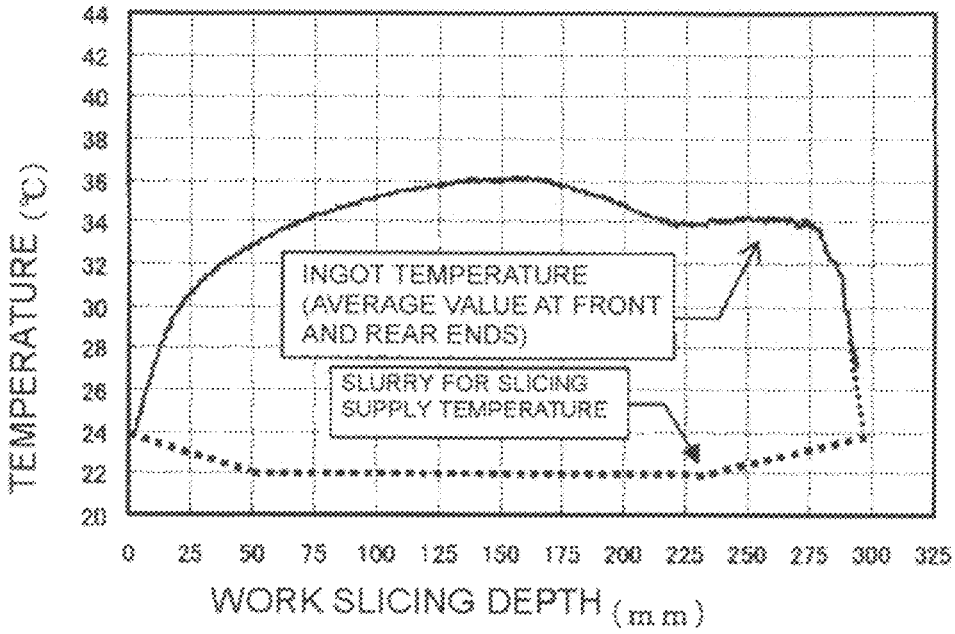
(B)
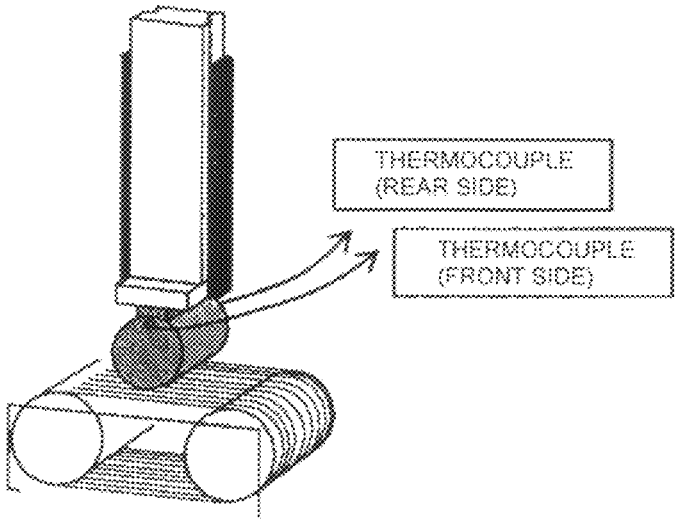

FIG.13
(A)
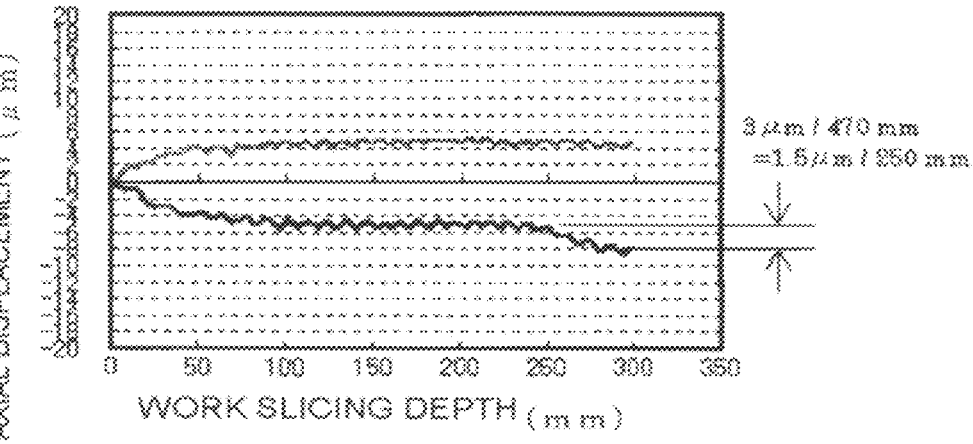
(B)
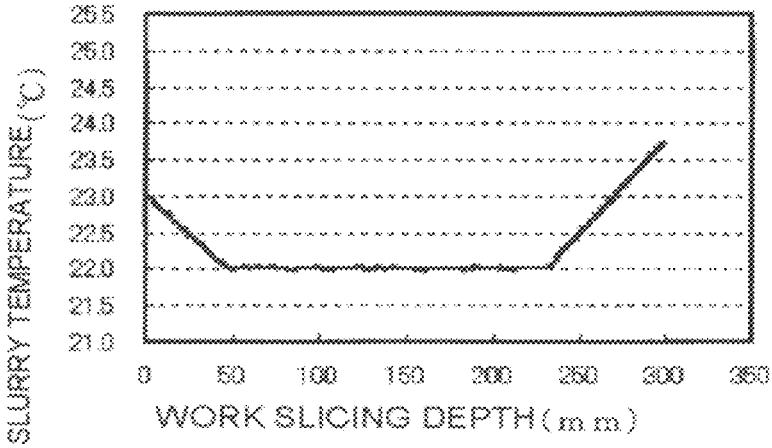
(C)
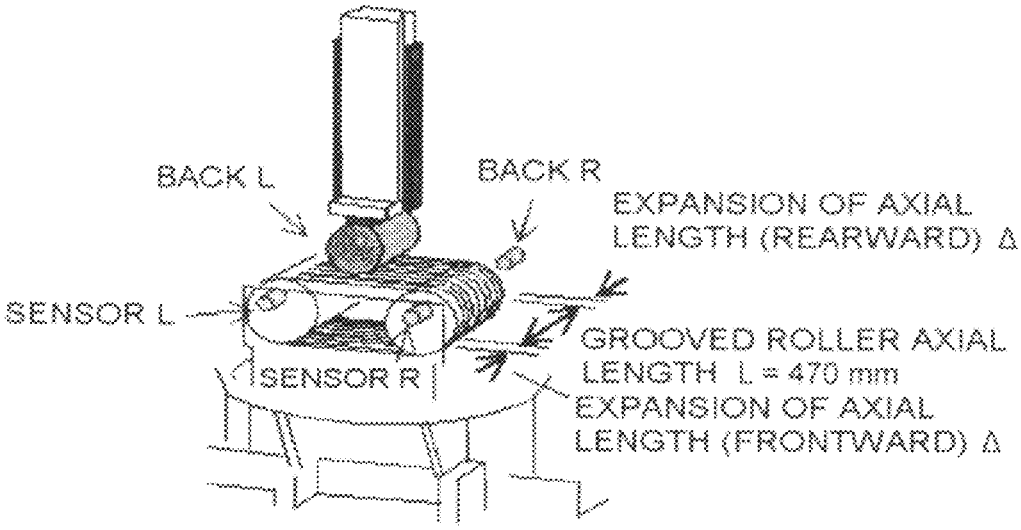

FIG.14
(A)
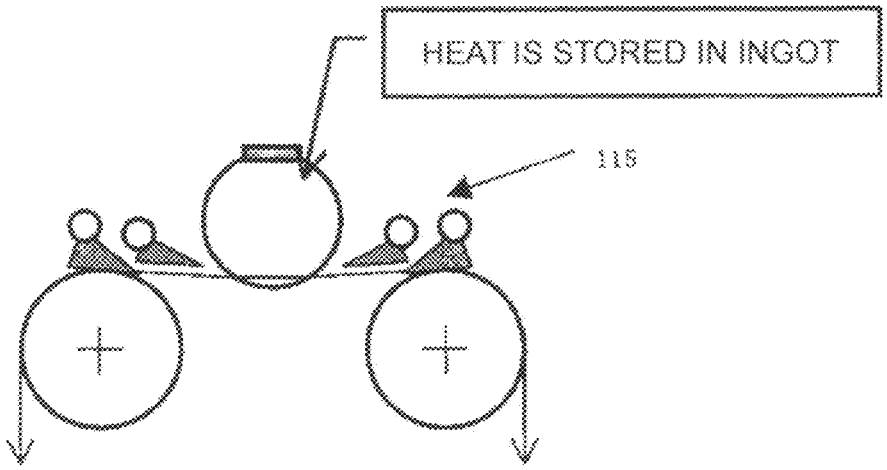
(B)
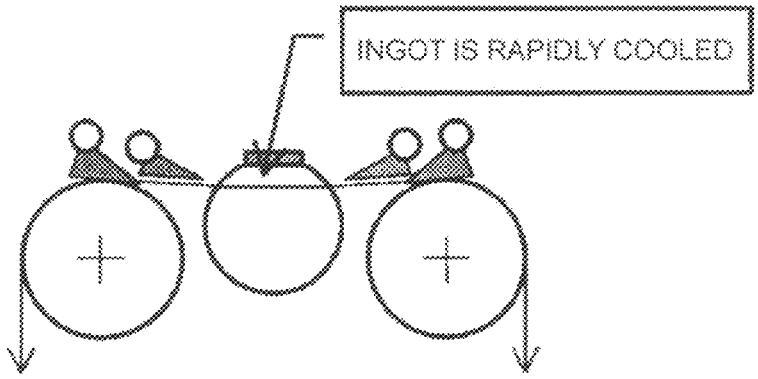

SLICING METHOD

TECHNICAL FIELD

The present invention relates to a slicing method for slicing, e.g., a silicon ingot or an ingot of a compound semiconductor into many wafers by using a wire saw.

BACKGROUND ART

In recent years, an increase in size of a wafer is demanded, and a wire saw is mainly used to slice an ingot with this increase in size.

The wire saw is a apparatus that allows a wire (a high-tensile steel wire) to travel at a high speed and presses an ingot (a work) against the wire to be sliced while applying a slurry to the wire, thereby slicing the ingot into many wafers at the same time (see Japanese Unexamined Patent Publication (Kokai) No. 262826-1997).

Here, FIG. 6 shows an outline of an example of a general wire saw.

As shown in FIG. 6, a wire saw 101 mainly includes a wire 102 that slices an ingot, grooved rollers 103 (wire guides) around which the wire 102 is wound, a mechanism 104 that gives the wire 102 a tensile force, a mechanism 105 that feeds the ingot to be sliced, and a mechanism 106 that supplies a slurry at the time of slicing.

The wire 102 is unreeled from one wire reel 107 and reaches the grooved rollers 103 through the tensile-force-giving mechanism 104 formed of a powder clutch (a constant torque motor 109), a dancer roller (a dead weight) (not shown) and so on through a traverser 108. The wire 102 is wound around this grooved rollers 103 for approximately 300 to 400 turns, and then taken up by a wire reel 107' through the other tensile-force-giving mechanism 104'.

Further, the grooved roller 103 is a roller that has a polyurethane resin press-fitted around a steel cylinder and has grooves formed at a fixed pitch on a surface thereof, and the wire 102 wound therearound can be driven in a reciprocating direction in a predetermined cycle by a driving motor 110.

It is to be noted that such an ingot-feeding mechanism 105 as shown in FIG. 7 feeds the ingot to the wire 102 wound around the grooved rollers 103 at the time of slicing the ingot. This ingot-feeding mechanism 105 includes an ingot-feeding table 111 that is used to feed the ingot, an LM guide 112, an ingot clump 113 for grasping the ingot, a slice pad plate 114, and others, and driving the ingot-feeding table 111 along the LM guide 112 under control of a computer enables feeding the ingot fixed at the end at a previously programmed feed speed.

Moreover, nozzles 115 are provided near the grooved rollers 103 and the wound wire 102, and a slurry can be supplied to the grooved rollers 103 and the wire 102 from a slurry tank 116 at the time of slicing. Additionally, a slurry chiller 117 is connected with the slurry tank 116 so that a temperature of the slurry to be supplied can be adjusted.

Such a wire saw 101 is used to apply an appropriate tensile force to the wire 102 from the wire-tensile-force-giving mechanism 104, and the ingot is sliced while causing the wire 102 to travel in the reciprocating direction by the driving motor 110.

On the other hand, in a wafer, a size of a surface waviness component that is called "nano-topography" is a problem in recent years. This nano-topography is obtained by taking a wavelength component having a wavelength $\lambda$=0.2 mm to 20 mm that is shorter than "Sori" or "Warp" and longer than "surface roughness" out of a surface shape of a wafer. And, this nano-topography is very shallow waviness having a PV value of 0.1 μm to 0.2 μm or below. It is said that this nano-topography affects a yield of an STI (Shallow Trench Isolation) process in device manufacture.

Although the nano-topography is produced in a wafer processing step (slicing to polishing), it was revealed that a nano-topography caused due to wire saw slicing (i.e., slice waviness) can be classified into three types, i.e., "one that is extemporaneously produced", "one that is produced in a position where slicing is started or ended", and "one having a periodicity" as shown in FIG. 8.

Of these types, one that is produced in "slicing start/end portion of a wafer" has a high rate that it is rejected in a numeric judgment regarding a nano-topography. In particular, a nano-topography in the "slicing end portion" has a higher rate than a nano-topography in the "slicing start portion". And the "slicing end portion" highly frequently becomes a position making a numeric value regarding a nano-topography the worst in a wafer radial direction or the nano-topography in the "slicing end portion" is rejected in the numeric judgment, and hence improvement is strongly demanded.

DISCLOSURE OF INVENTION

Thus, the present inventors examined nano-topographies in sliced wafers sliced by using such a conventional wire saw as shown in FIG. 6.

FIG. 9 shows Warp cross-sectional shapes measured by an electric capacitance type measuring instrument and "pseudo nano-topographies" of the sliced wafers. The pseudo nano-topography means obtaining a numeric value having a correlation with a nano-topography of a polished wafer in a pseudo manner by applying a band-pass filter having simulated processing characteristics of lapping, grinding, and polishing with respect to Warp cross-sectional wave shape of the sliced wafer.

In general, the nano-topography is measured after polishing but, when a pseudo nano-topography is obtained from the sliced wafer and the obtained pseudo nano-topography is used, a cost and a time do not have to be increased, and a nano-topography caused due to an influence of slicing alone can be readily examined without being affected by a factor in a process such as polishing after slicing.

It was understood from such an examination that a nano-topography near a slicing end portion that is demanded to be improved the most in the conventional technology is caused due to a precipitous change in a Warp shape of a wafer in this position.

FIG. 9(A) shows a wafer holding small change in shape in a position near a slicing end portion as depicted in a shape map, and a size of a change of a pseudo nano-topography is suppressed to the range of ±0.1 μm and relatively small in the position near the slicing end portion as can be understood from the pseudo nano-topography. On the other hand, as shown in FIG. 9(B) or FIG. 9(C), it can be understood that, when a shape in the position near the slicing end portion is precipitously changed, a size of a pseudo nano-topography falls within the range of −0.3 to 0.4 in this position and is larger than that depicted in FIG. 9(A).

It is to be noted that, if a change in the entire shape is gentle even though this change is slightly large, the nano-topography is hardly produced. A precipitous change in shape greatly affects the nano-topography.

Thus, a factor of generation of such a precipitous change in a sliced wafer in the position near the slicing end portion as shown in FIG. 9 was examined.

First, FIG. 10 shows an example of a change in shape of a sliced wafer, i.e., a slicing trajectory of the wire at the time of ingot slicing. As shown in FIG. 10, a trajectory of the wire greatly spreads on the outer side in slicing end portions near both ends of an ingot in particular, whereby a Warp cross-sectional shape of the sliced wafer is precipitously changed.

As a possibility of occurrence of such a cross-sectional shape (a slicing trajectory), the following two hypotheses can be considered.

One is a case where a slicing trajectory formed by the wire is bent toward an end of the ingot when the ingot is contracted in an axial direction thereof in a time close to end of slicing as shown in FIG. 11(A), and the other is a case where the slicing trajectory is bent when the grooved rollers having the wire that slices the ingot wound therearound are expanded in an axial direction thereof as shown in FIG. 11(B).

The present inventors conducted a test and examined an influence of each of these possibilities on the slicing trajectory.

A possibility that the ingot is contracted in the axial direction as shown in FIG. 11(A) was first examined.

Such a wire saw as depicted in FIG. 6 was used to slice a silicon ingot having a diameter of 300 mm and a length of 250 mm prepared for the test. A tensile force of 2.5 kgf was applied to the wire, and the wire was caused to travel in a reciprocating direction at an average speed of 500 m/min in a cycle of 60 s/c to perform slicing. Further, a supply temperature of a slurry for slicing had a temperature profile depicted in FIG. 12(A). It is to be noted that a temperature was measured at both ends (positions having a slicing depth of 285 mm) of the ingot by using a thermocouple (see FIG. 12(B)).

FIG. 12(A) shows a result obtained by measuring a change in temperature of the ingot during a slicing process.

A temperature of the ingot was increased by 13° C. to become approximately 36° C. at maximum during the slicing process, and it was precipitously reduced approximately 10° C. near a slicing end portion (a slicing depth of 275 mm to 300 mm in this example). This coincides with a position where the Warp shape suddenly changes near the slicing end portion. Additionally, it can be understood from calculation using a thermal expansion coefficient that the ingot is precipitously contracted approximately 10 μm in the axial direction near the slicing end position.

It can be considered that this contraction occurs because a temperature of the ingot is rapidly reduced to the same temperature as that of the slurry for slicing when a slicing load is reduced to ½ or below of a maximum value or when the ingot moves down with advancement of slicing and the slurry for slicing cooled to 22° C. to 24° C. is directly applied to the ingot, for example.

It is to be noted that the temperature of the ingot, which was once decreased, is again increased at a slicing depth 200 mm or a further depth in FIG. 12(A) because a flow quantity of the slurry is reduced here.

A possibility that the grooved rollers are expanded in the axial direction thereof as shown in FIG. 11(B) was examined.

The same silicon ingot was sliced under the same slicing conditions as those of the above-explained test except a supply temperature of a slurry, and expansion of the grooved roller in the axial direction was measured (see FIG. 13(A)). It is to be noted that a supply temperature of a slurry for slicing had a temperature profile depicted in FIG. 13(B).

Further, expansion of the grooved roller in the axial direction was measured by arranging an eddy current sensor in close proximity to the axial direction of the grooved roller (see FIG. 13(C)).

As shown in FIG. 13(A), the grooved roller was gently expanded in a major part, but a front side of the grooved roller had a relatively high expansion rate near a slicing end portion (it is to be noted that an upper line in FIG. 13(A) indicates an amount of rearward expansion of the grooved roller depicted in FIG. 13(C) and a lower line indicates an amount of frontward expansion of the same). However, in the current test, an expansion amount at this portion (regarding approximately 250 mm corresponding to an ingot length) was as relatively small as approximately 1 μm to 2 μm, and it was revealed that an influence on a slicing trajectory is small. It can be considered that temperature adjustment for a grooved roller core grid, a main spindle, and a bracket efficiently functions in an apparatus utilized in the current test.

With the above-explained circumstances, it can be considered that a primary factor of a sudden change in slicing trajectory near the slicing end portion that is a problem, i.e., a sudden change in Warp shape in the sliced wafer is contraction of the ingot in the axial direction depicted in FIG. 11(A).

As explained above, the slurry for slicing is rarely directly applied to the ingot and the ingot is hard to be cooled from start of slicing to a middle stage of slicing, and processing heat is stored in the ingot (see FIG. 14(A)). As a result, a temperature of the ingot is increased 13° C. at maximum. Thermal expansion of the ingot involved by this temperature increase is approximately 10 μm in calculation (with respect to the ingot having a length of 250 mm). On the other hand, near the slicing end portion, as shown in FIG. 14(B), the slurry is directly applied to the ingot to reduce a temperature of the ingot and a slicing load is decreased to ½, and the temperature of the ingot is precipitously reduced by 10° C. As a result, the work is thermally contracted, which is a factor of a sudden change in Warp shape. As shown in FIG. 11(A), an influence of this thermal expansion/thermal contraction becomes large when the ingot has a longer length or when getting closer to both ends of the ingot.

Therefore, in view of the above-explained problems, it is an object of the present invention to provide a method for alleviating precipitous cooling of an ingot in a time close to end of slicing of the ingot, consequently suppressing generation of a nano-topography, and slicing into high-quality wafers having a uniform thickness when slicing the ingot by using a wire saw.

To achieve this object, the present invention provides a slicing method comprising winding a wire around a plurality of grooved rollers and pressing the wire against an ingot to be sliced into wafers while supplying a slurry for slicing to the grooved rollers and causing the wire to travel, wherein a cooling speed of the ingot when a slicing depth is equal to or above ⅔ of a diameter is controlled to perform slicing by supplying a slurry for adjusting an ingot temperature to the ingot independently from the slurry for slicing while controlling a supply temperature only in a period from the moment that the slicing depth of the ingot reaches at least ⅔ of the diameter to end of slicing.

When the slurry for adjusting an ingot temperature is supplied to the ingot independently from the slurry for slicing while controlling a supply temperature only in a period from the moment that a slicing depth of the ingot reaches at least ⅔ of the diameter to the moment that slicing is finished as explained above, the cooling speed of the ingot can be controlled in the above-mentioned range, rapid cooling of the ingot that occurs near a slicing end portion can be thereby alleviated, and occurrence of precipitous changes in slicing trajectory and Warp shape can be suppressed, thereby a nano-topography can be improved.

Further, restricting supply of the slurry for adjusting an ingot temperature to the ingot to a position near the slicing end portion enables appropriately slicing a central region of the ingot without disorder of flows of the slurries as different from a later-explained conventional technique. As a result, a high-quality wafer having a uniform thickness in the entire wafer can be obtained without becoming a sliced wafer having a considerably changed thickness in a central region thereof.

At this time, it is desirable that supply of the slurry for adjusting an ingot temperature is started at a temperature of the ingot when the slicing depth reaches at least ⅔ of the diameter and then the slurry for adjusting an ingot temperature is supplied while gradually reducing a supply temperature thereof.

As explained above, in supply of the slurry for adjusting an ingot temperature, when supply is started at the same temperature as a temperature of the ingot when the slicing depth reaches at least ⅔ of the diameter, i.e., a temperature of the ingot when starting supply of the slurry for adjusting an ingot temperature and then the slurry is supplied while gradually reducing the supply temperature, rapid cooling of the ingot in the slicing end portion can be very efficiently alleviated.

Furthermore, at this time, it is preferable that the supply temperature of the slurry for adjusting an ingot temperature is reduced to be equal to a supply temperature of the slurry for slicing at end of slicing.

When the temperature of the slurry for adjusting an ingot temperature is set to be equal to the supply temperature of the slurry for slicing at the end of slicing as explained above, excessive cooling can be avoided in the time close to end of slicing of the ingot, and the temperature of the ingot can be further smoothly reduced to the temperature of the slurry for slicing, thus further occurrence of rapid cooing of the ingot can be effectively reduced.

According to the slicing method of the present invention, rapid cooling of the ingot can be reduced in the time close to end of slicing, a nano-topography can be effectively suppressed, and a high-quality wafer having a uniform wafer thickness even in a central region can be obtained.

BRIEF DESCRIPTION OF DRAWINGS

FIG. 2 are graphs each showing a supply temperature profile of a slurry in Example, wherein FIG. 2(A) shows a supply temperature profile of a slurry for slicing and FIG. 2(B) shows the same of a slurry for adjusting an ingot temperature;

FIG. 5 are graphs each showing a level of a pseudo nano-topography, wherein FIG. 5(A) shows a result of Example and FIG. 5(B) shows a result of Comparative Example 1;

FIG. 8 is an explanatory view showing classification of nano-topographies caused due to wire saw slicing;

FIG. 11(A) is an explanatory view showing an example of contraction of an ingot and slicing trajectories at the time of slicing the ingot, and FIG. 11(B) is an explanatory view showing an example of expansion of a grooved roller and slicing trajectories at the time of slicing the ingot;

FIG. 12 show a test result about a possibility of contraction of the ingot in an axial direction, wherein FIG. 12(A) is a graph showing a temperature change of the ingot during slicing and a supply temperature profile of a slurry for slicing and FIG. 12(B) is an explanatory view for explaining a measurement method for a temperature of the ingot;

FIG. 13 show a test result about a possibility of expansion and contraction of the grooved roller in an axial direction, wherein FIG. 13(A) is a graph showing an expansion and contraction change of the grooved roller during slicing, FIG. 13(B) is a graph showing a supply temperature profile of the slurry for slicing, and FIG. 13(C) is an explanatory view for explaining a measurement method for an expansion and contraction amount of the grooved rollers;

FIG. 14 are explanatory views for explaining a process that the ingot is rapidly cooled, wherein FIG. 14(A) shows the time of starting slicing and FIG. 14(B) shows a position near a slicing end portion;

FIG. 17 are explanatory views for explaining an interference of the slurry for slicing and the slurry for adjusting an ingot temperature, wherein FIG. 17(A) shows the time of starting slicing and FIG. 17(B) shows a moment where a central region of an ingot is sliced.

BEST MODES FOR CARRYING OUT THE INVENTION

Although an embodiment according to the present invention will be explained hereinafter, but the present invention is not restricted thereto.

Figure 6:
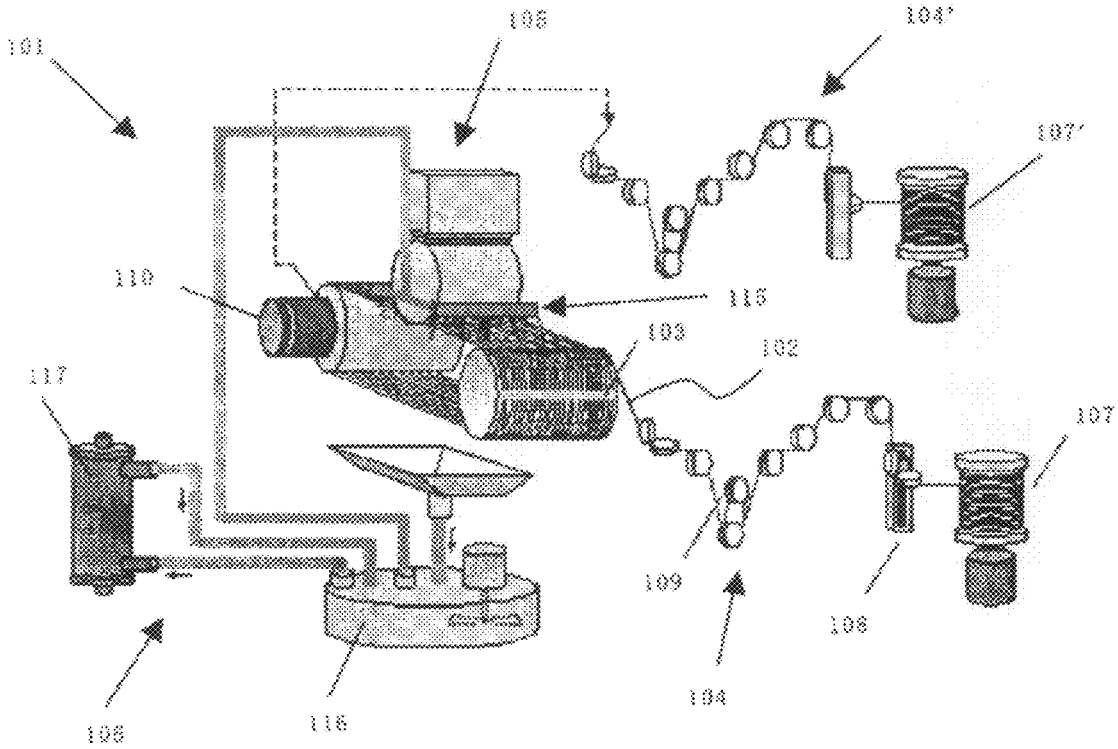
FIG. 6 is a schematic view showing an example of a wire saw used in a conventional slicing method.
Figure 7:
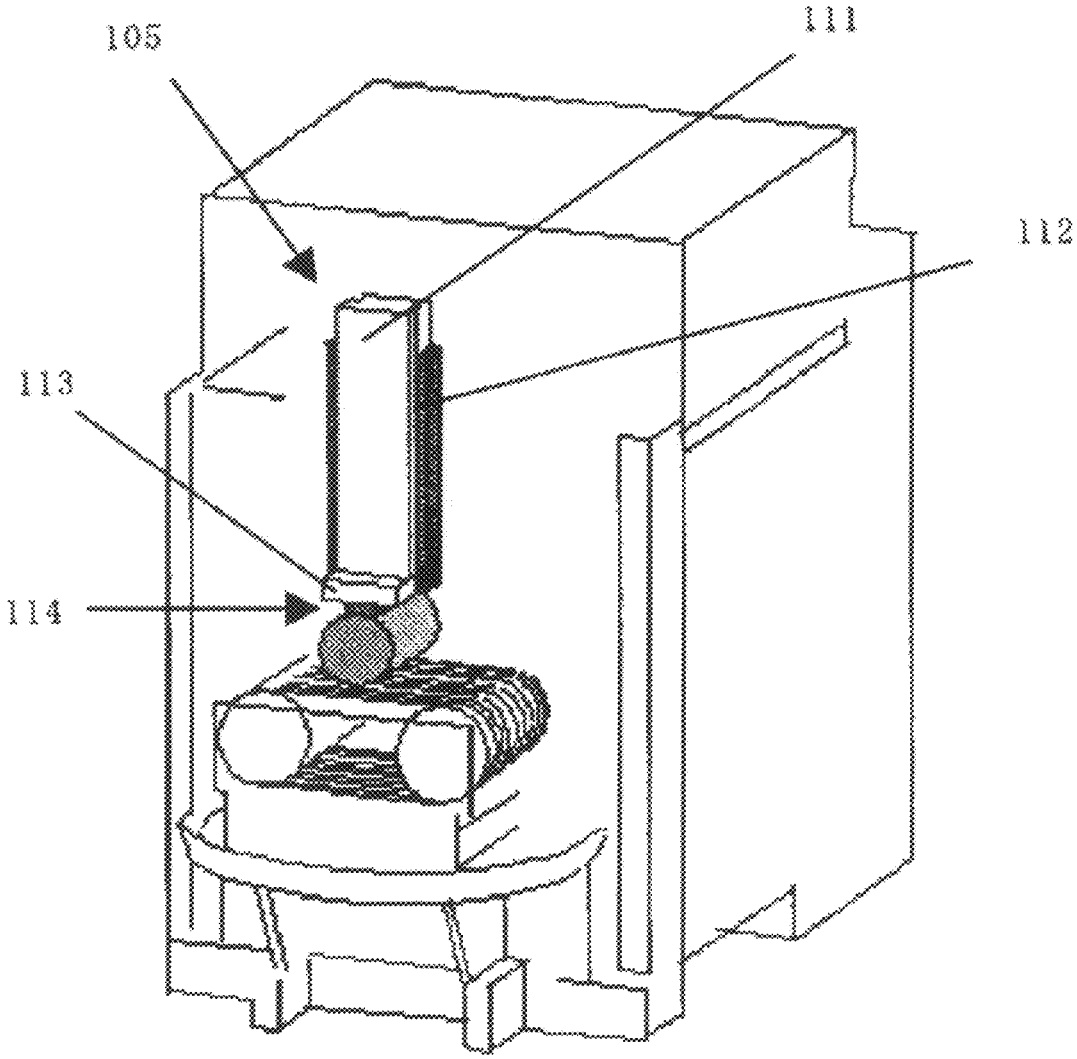
FIG. 7 is a schematic view showing an example of an ingot-feeding mechanism.

For example, when such a wire saw as shown in FIG. 6 is used to slice an ingot into wafers, in the obtained sliced wafers, such a precipitous change in shape as shown in FIG. 9(B) or FIG. 9(C) is observed near a slicing end portion, and it is revealed that a nano-topography on a large level is produced at a corresponding position.

As explained above, as a major factor of this precipitous change in shape, it can be considered that the ingot is rapidly cooled and contracted in the time close to end of slicing and a slicing trajectory is precipitously bent.

Figure 15:
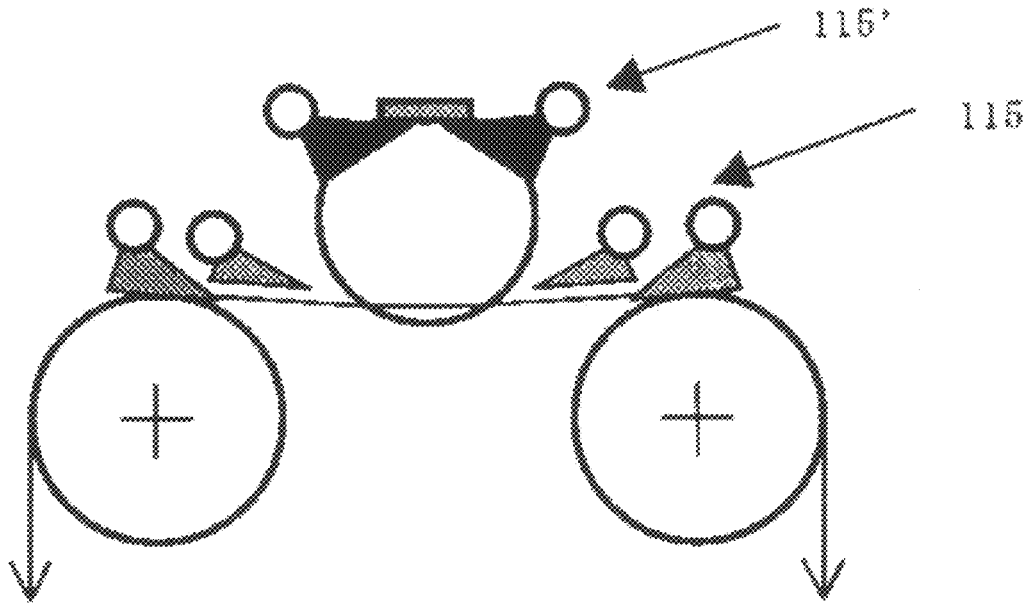
FIG. 15 is an explanatory view for explaining a nozzle of a slurry for slicing and a nozzle of a slurry for adjusting an ingot temperature.

Here, to control a temperature of the ingot at the time of slicing, a publication No. WO00/43162 discloses a technique of supplying a slurry for slicing to a grooved rollers (a nozzle 115 of a slurry for slicing) and supplying a slurry for adjusting an ingot temperature that is used to adjust a temperature of the ingot to the ingot (a nozzle 115' of a slurry for adjusting an ingot temperature) at the time of slicing the ingot (see FIG. 15).

Figure 16:
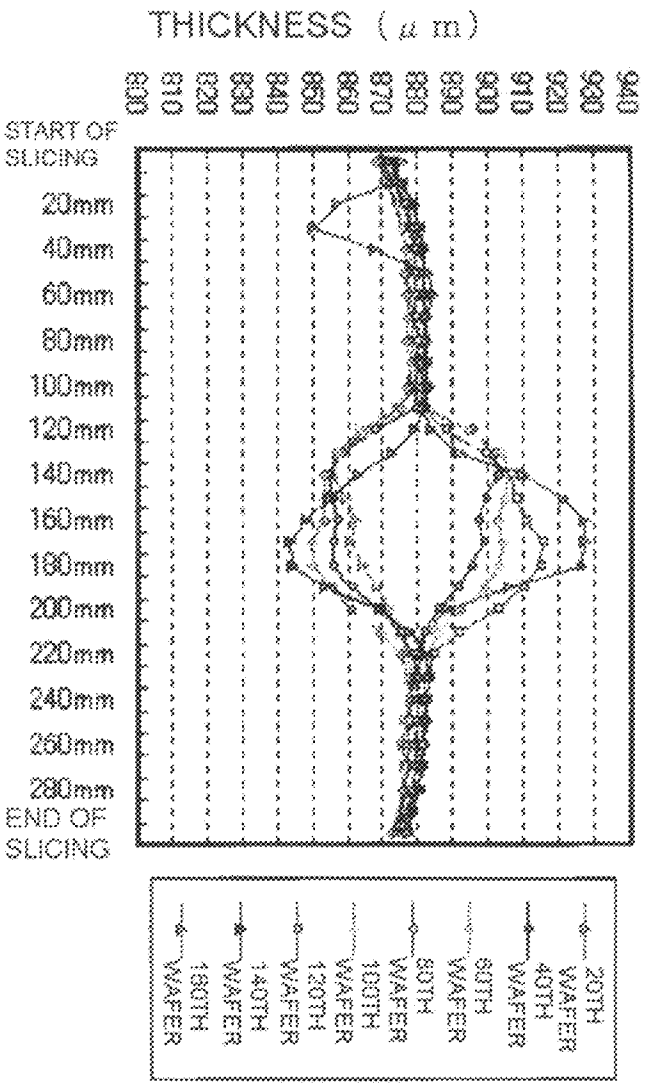
FIG. 16 is a graph showing a thickness shape of a sliced wafer obtained by a conventional method for slicing an ingot while keeping supply of the slurry for adjusting an ingot temperature from start of slicing to end of slicing.

However, the present inventors examined a sliced wafer obtained by such a conventional technique and thereby discovered that an accuracy of a wafer thickness is three times to twenty times of that in standard conditions and thickness uniformity is considerably degraded in a central region of the wafer (see FIG. 16). It is actually hard to use such a wafer as a product.

Figure 17:
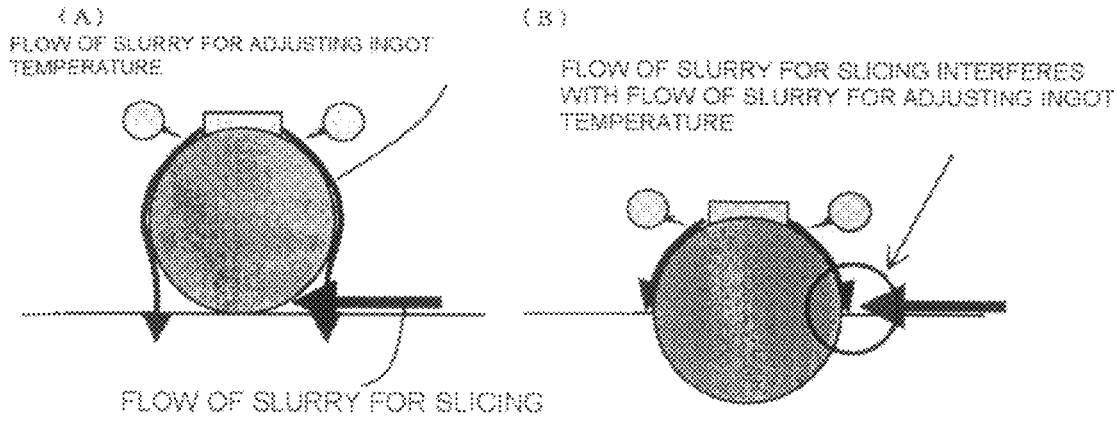

Thus, the present inventors repeatedly keenly studied about a method that can reduce rapid cooling by controlling a temperature of the ingot and a change in wafer thickness in the publication No. WO00/43162, and thereby found that adopting the conventional method of slicing the ingot while supplying the slurry for slicing to the grooved rollers and supplying the slurry for adjusting an ingot temperature to the ingot from start of slicing to end of slicing causes great interference of the slurry for slicing and the slurry for adjusting an ingot temperature to disorder flows of these slurries when slicing advances to slice a central region of the ingot, thus greatly affecting a sliced shape in the central region of the ingot (FIG. 17). As a result, such a sliced wafer in which an accuracy of a thickness considerably deviates from standard conditions in the central region as shown in FIG. 16 is obtained.

Moreover, the present inventors further proceeded studies, and thereby discovered that the ingot can be sliced into each sliced wafer having a desired thickness without degrading a thickness in the central region, and a temperature of the ingot near a slicing end portion in particular can be controlled to suppress rapid cooing, and the sliced wafer having a considerably improved nano-topography can be thus obtained, by supplying the slurry for adjusting an ingot temperature to the ingot only in a period after a slicing depth of the ingot reaches at least ⅔ of a diameter until slicing is finished rather than supplying the slurry for adjusting an ingot temperature in the entire period of slicing the ingot from start of slicing to end of slicing like a conventional method, thereby bringing the present invention to completion.

A slicing method using a wire saw according to the present invention will now be explained in detail hereinafter with reference to the drawings, but the present invention is not restricted thereto.

Figure 1:
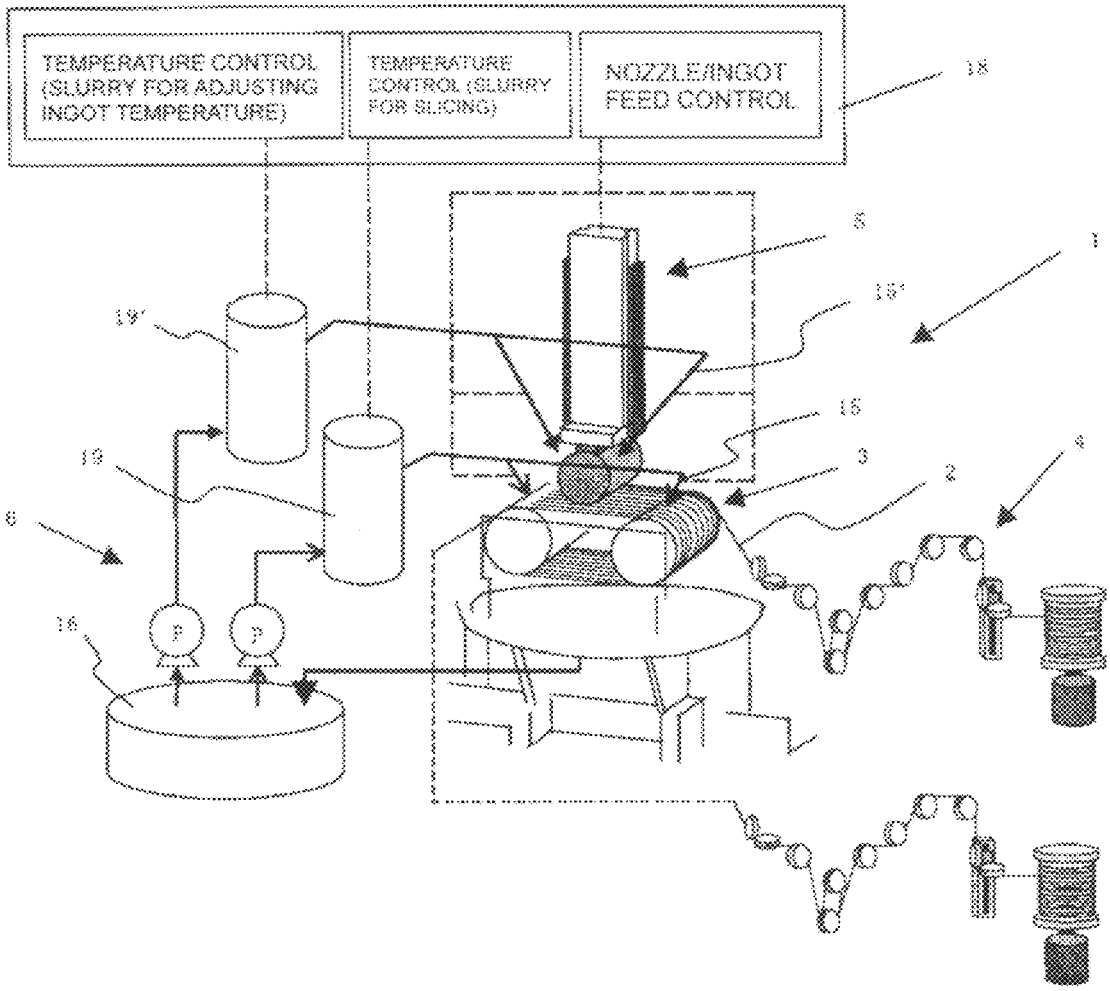
FIG. 1 is a schematic view showing an example of a wire saw that can be used in a slicing method according to the present invention.

FIG. 1 shows an example of a wire saw that can be used for the slicing method according to the present invention.

As shown in FIG. 1, a wire saw 1 mainly includes a wire 2 to slice an ingot, grooved rollers 3, wire-tensile-force-giving mechanisms 4, and an ingot-feeding mechanism 5, and a slurry-supplying mechanism 6.

Here, the slurry-supplying mechanism 6 will be first explained. As this slurry supplying mechanism 6, nozzles 15 that supply a slurry for slicing to the grooved rollers 3 (the wire 2) and nozzles 15' that directly supply a slurry for adjustment of a temperature of the ingot to the ingot to be sliced are arranged. Additionally, each of supply temperatures of the slurry for slicing and the slurry for adjusting an ingot temperature supplied from these nozzles 15 and 15' can be independently controlled. Specifically, for example, as shown in FIG. 1, the supply temperatures of the slurry for slicing and the slurry for adjusting an ingot temperature can be separately controlled by connecting one slurry tank 16 with the nozzles 15 and 15' through a heat exchanger (for the slurry for slicing) 19 and a heat exchanger (for the slurry for adjusting an ingot temperature) 19' respectively which are different from each other and controlled by a computer 18.

It is to be noted that the present invention is not of course restricted to the structure depicted in FIG. 1 and a structure that separately controls temperatures of the slurries in respective tanks, i.e., supply temperatures of the slurries can be achieved by arranging the separate slurry tanks and connecting slurry chillers for the respective slurry tanks. A mechanism that can independently control supply temperatures of the slurry for slicing and the slurry for adjusting an ingot temperature can suffice.

These types of slurries are not restricted in particular, and the same types as those in the conventional example can be used. For instance, a slurry obtained by dispersing GC (silicon carbide) abrasive grains in a liquid can be used.

Further, the nozzles 15 that supplies the slurry for slicing, the nozzles 15' that supplies the slurry for adjusting an ingot temperature, and the ingot-feeding mechanism 5 are connected with the computer 18, predetermined amounts of the slurry for slicing and the slurry for adjusting an ingot temperature can be automatically sprayed to the grooved rollers 3 and the ingot at predetermined timings from the nozzles 15 and nozzles 15' respectively with respect to a predetermined feeding amount of the ingot, i.e., a predetermined slicing amount of the ingot by using a preset program.

Although the feeding amount of the ingot, the spraying amounts of the slurry and timings, and supply temperatures of the slurries can be controlled in a desired manner by the computer 18, controlling means is not restricted thereto in particular.

Furthermore, the wire 2, the grooved rollers 3, the wire-tensile-force-giving mechanisms 4, and the ingot-feeding mechanism 5 except the slurry-supplying mechanism 6 can be the same as those in the wire saw 101 used in the conventional slicing method depicted in FIG. 6.

A type and a thickness of the wire 2, a groove pitch of the grooved roller 3, a structure in any other mechanism, and others are not restricted in particular, and they can be determined each time so that desired slicing conditions can be obtained in accordance with the conventional method.

For example, the wire 2 can be formed of, e.g., a special piano wire having a width of approximately 0.13 mm to 0.18 mm, and the grooved roller 3 having a groove pitch of (a desired wafer thickness+a slicing removal) can be adopted.

A procedure of carrying out the slicing method according to the present invention by using such a wire saw 1 will now be explained hereinafter.

First, the ingot-feeding mechanism 5 is used to feed a grasped ingot toward a lower position at a predetermined speed, and the grooved rollers 3 are driven, thereby causing the wire 2 to which a tensile force is given by the wire-tensile-force-giving mechanisms 4 to travel in a reciprocating direction. It is to be noted that a magnitude of the tensile force given to the wire 2, a traveling speed of the wire 2, and others at this time can be appropriately set. For example, a tensile force of 2.5 kgf to 3.0 kgf can be applied to cause the wire 2 to travel in the reciprocating direction at an average speed of 400 m/min to 600 m/min in a cycle of 1 c/min to 2 c/min (30 s/c to 60 s/c). These values can be determined in accordance with, e.g., the ingot to be sliced.

Furthermore, although the nozzles 15 are used to start spraying the slurry for slicing toward the grooved rollers 3 and the wire 2, a supply temperature and others of this slurry can be also freely set. For example, an approximately room temperature (25° C.) can be set.

Moreover, slicing of the ingot is advanced under such conditions, the slurry for adjusting an ingot temperature is directly sprayed toward the ingot from the nozzles 15' to start supply under, e.g., control of the computer 18 based on a preset program after a slicing depth of the ingot reaches at least ⅔ of a diameter through a central region, and supply is carried out until slicing of the ingot is finished.

As explained above, in the slicing method according to the present invention, the slurry for adjusting an ingot temperature is supplied only in a period from the moment that the slicing depth of the ingot reaches at least ⅔ to end of slicing.

At this time, it is preferable that a supply temperature of the slurry for adjusting an ingot temperature is set to, e.g., a temperature when the slicing depth of the ingot reaches at least ⅔, i.e., the same temperature as a temperature of the ingot when supply of the slurry for adjusting an ingot temperature is started and then this supply temperature is gradually reduced. As a result, supply can be started without precipitously changing a temperature of the ingot during a slicing process.

Moreover, it is preferable to set the slurry for adjusting an ingot temperature to the same supply temperature as a temperature of the slurry for slicing fed from the nozzles 15 at the end of slicing.

When the supply temperature is controlled in this manner to supply the slurry for adjusting an ingot temperature to the ingot, a cooling speed of the ingot having the slicing depth being equal to or above ⅔ of the diameter that is a problem in the conventional example can be controlled, and precipitous cooling in, especially, the period close to end of slicing can be considerably alleviated. In particular, as explained above, when a profile of the supply temperature is set to a profile in which the supply temperature at start of supply is set to the same temperature as the ingot and the supply temperature is then gradually reduced to set the same as the supply temperature of the slurry for slicing at end of slicing, the ingot can be gently cooled, thereby effectively avoiding rapid cooling of the ingot. As a result, a precipitous change in slicing trajectory can be prevented, a position where a Warp shape precipitously varies can be eliminated in each obtained sliced wafer, and a nano-topography produced near a slicing end portion can be greatly improved.

Additionally, in the present invention, as explained above, the slurry for adjusting an ingot temperature is supplied only in a period from the moment that the slicing depth of the ingot reaches at least ⅔ of the diameter to end of slicing. The slurry for adjusting an ingot temperature is supplied from start of slicing to end of slicing and the slurry for adjusting an ingot temperature largely interferes with the slurry for slicing to degrade an accuracy of a wafer thickness in an ingot central region when this central region is sliced in the conventional method, but the slurry for adjusting an ingot temperature is not supplied at the time of slicing the ingot central region in the present invention as different from the conventional method, and hence the interference of the slurries of course does not occur and the central region of the ingot can be appropriately sliced, thereby the sliced wafer whose entire region including the central region is sliced to have a desired thickness is obtained.

Figure 9:
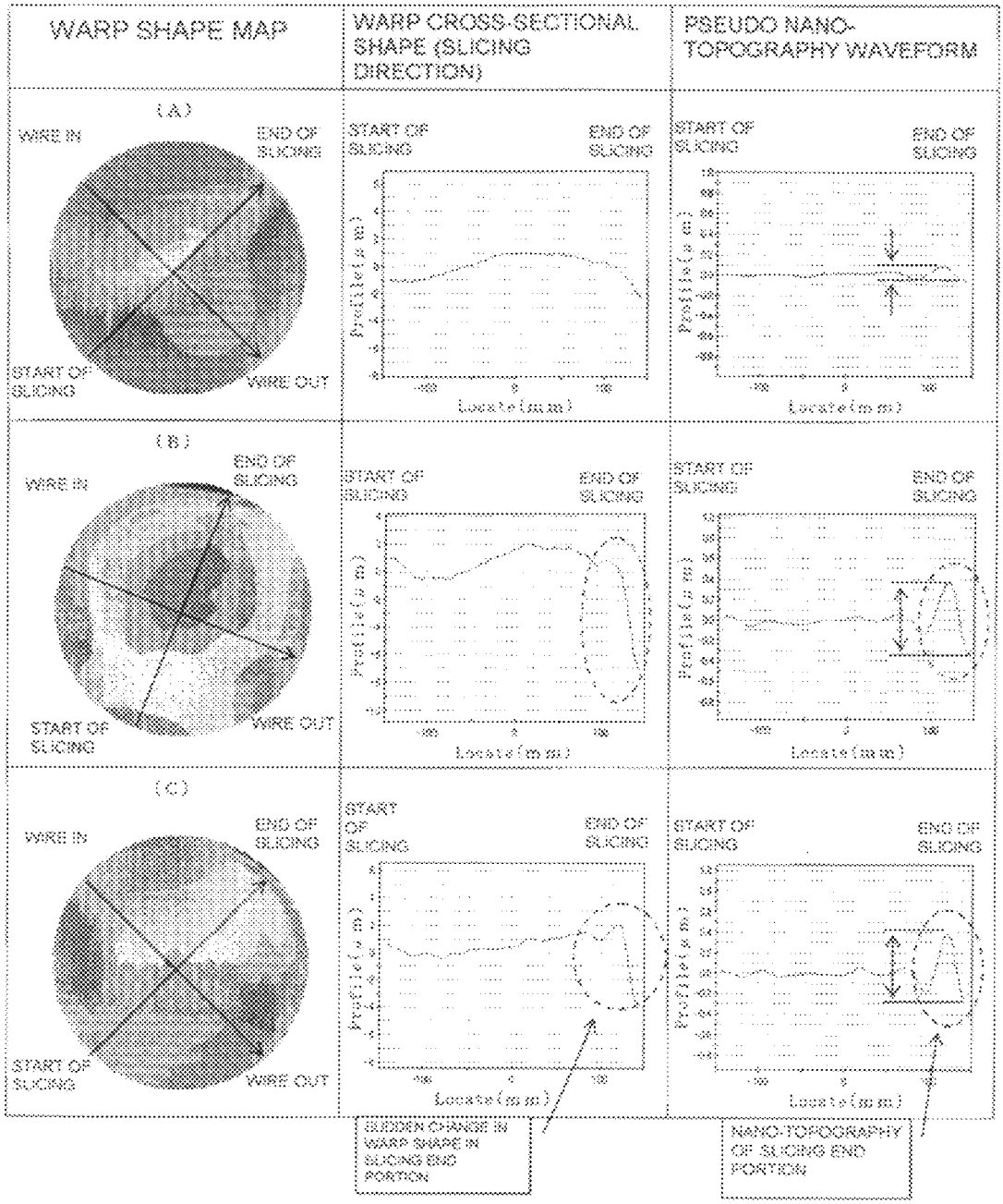
FIG. 9 is a measurement view of Warp cross-sectional shapes and pseudo nano-topography waveforms of sliced wafers.
Figure 10:
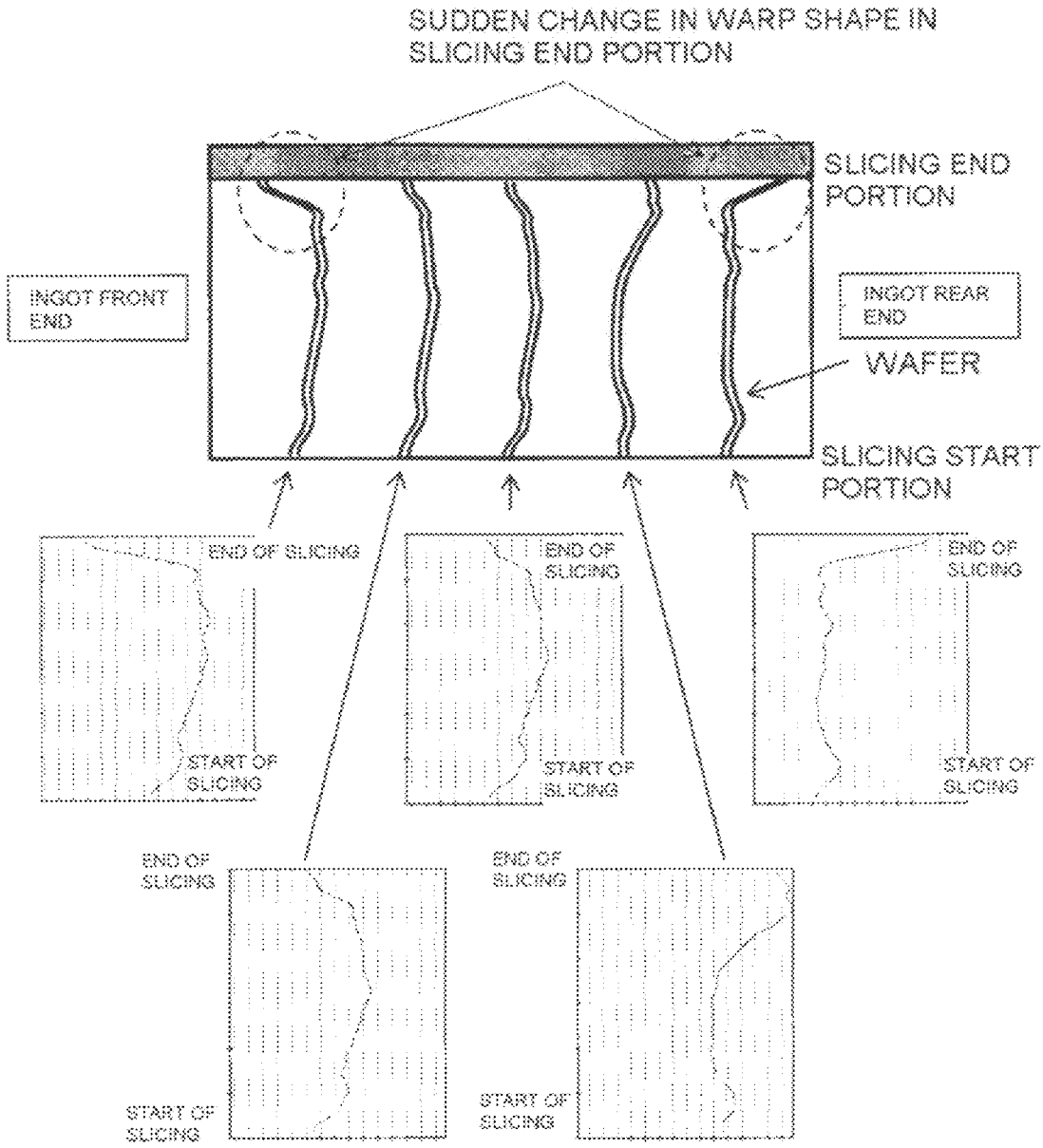
FIG. 10 is a schematic view showing an example of slicing trajectories of a wire at the time of slicing an ingot.

It is to be noted that a timing for starting supplying the slurry for adjusting an ingot temperature is not restricted in particular as long as the slicing depth is equal to or above at least ⅔ of the diameter, but setting the timing to the moment before rapid cooling of the ingot occurs is of course desirable. That is, as shown in FIG. 9, a sudden change in ingot temperature (a sudden change in Warp cross-sectional shape) in the time of end of slicing starts when the slicing depth is approximately 240 mm/300 mm, and it is better to start supplying the slurry for adjusting an ingot temperature before this sudden change. However, an effect can be obtained even when supply is started when the slicing depth is equal to or above 275 mm/300 mm where rapid cooling of the ingot actually occurs. On the other hand, according to FIG. 16, the slurry for adjusting an ingot temperature is supplied at the slicing depth of 200 mm/300 mm or above where poor quality in an accuracy in the central region converges. The supply timing can be appropriately set in accordance with various kinds of conditions, e.g., a degree of interference of the slurry for adjusting an ingot temperature and the slurry for slicing or a timing at which the ingot is rapidly cooled.

The present invention will be explained in more detail based on examples, but the present invention is not restricted thereto.

EXAMPLE

A wire saw shown in FIG. 1 was used to cut a silicon ingot having a diameter of 300 mm and an axial length of 200 mm into wafers based on the slicing method according to the present invention, thereby 190 sliced wafers were obtained.

A wire having a width of 160 μm was used, and a tensile force of 2.5 kgf was applied to cause the wire to travel in a reciprocating direction at an average speed of 500 m/min in a cycle of 60 s/c, thereby slicing was performed. A slurry for slicing was supplied from start of slicing, and it was supplied to grooved rollers with a temperature profile depicted in FIG. 2(A). Furthermore, a slurry for adjusting an ingot temperature was supplied only when a slicing depth is 218 mm or above, supply was started at a supply temperature of 33° C. close to a temperature of the ingot (35° C.) at that moment, and a temperature profile depicted in FIG. 2(B) was used.

It is to be noted that a material obtained by mixing GC#1500 with a coolant at a weight rate of 1:1 was used as each slurry.

Moreover, thermocouples were arranged as shown in FIG. 12(B) to measure a change in temperature of the ingot during slicing.

Figure 3:
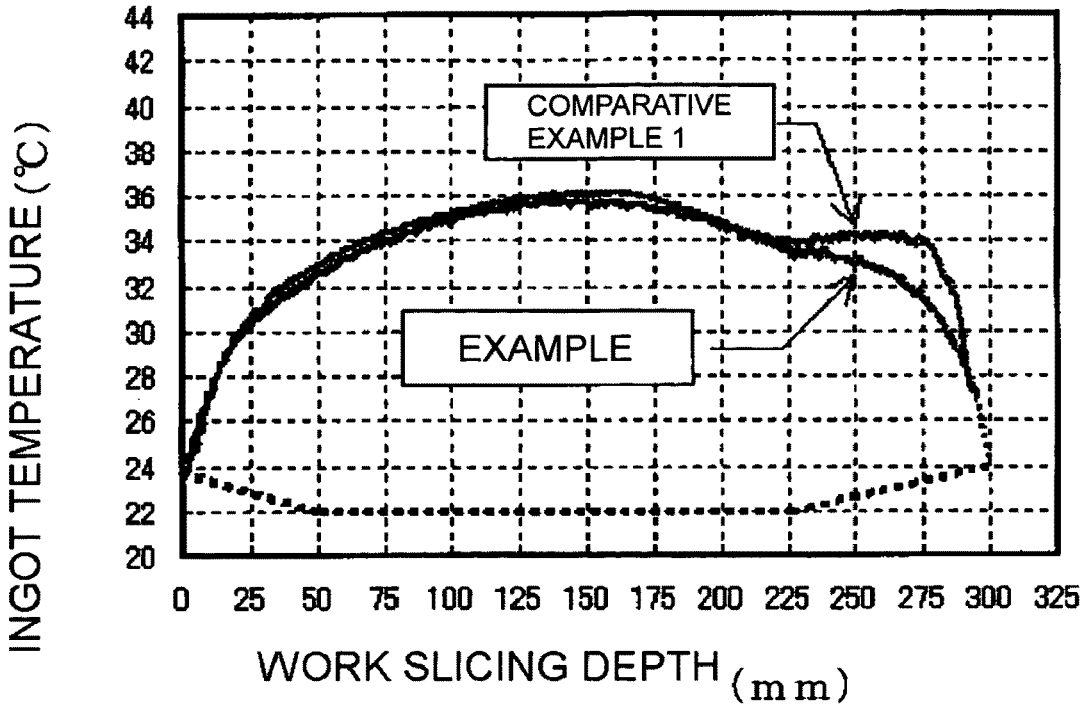
FIG. 3 is a graph showing a temperature change of the ingot in Example.

FIG. 3 shows a change in temperature of the ingot at this time. FIG. 3 also depicts a change in temperature of the ingot when the slurry for adjusting an ingot temperature is not supplied for a comparison (later-explained Comparative Example 1).

As shown in FIG. 3, it can be understood that the ingot was moderately cooled in the range of 218 mm where supply was started to 300 mm where slicing was finished and rapid cooling was sufficiently alleviated at a position near a slicing end portion when the slurry for adjusting an ingot temperature was supplied in accordance with the temperature profile depicted in FIG. 2(B), as different from Comparative Example 1 using the conventional slicing method.

Figure 4:
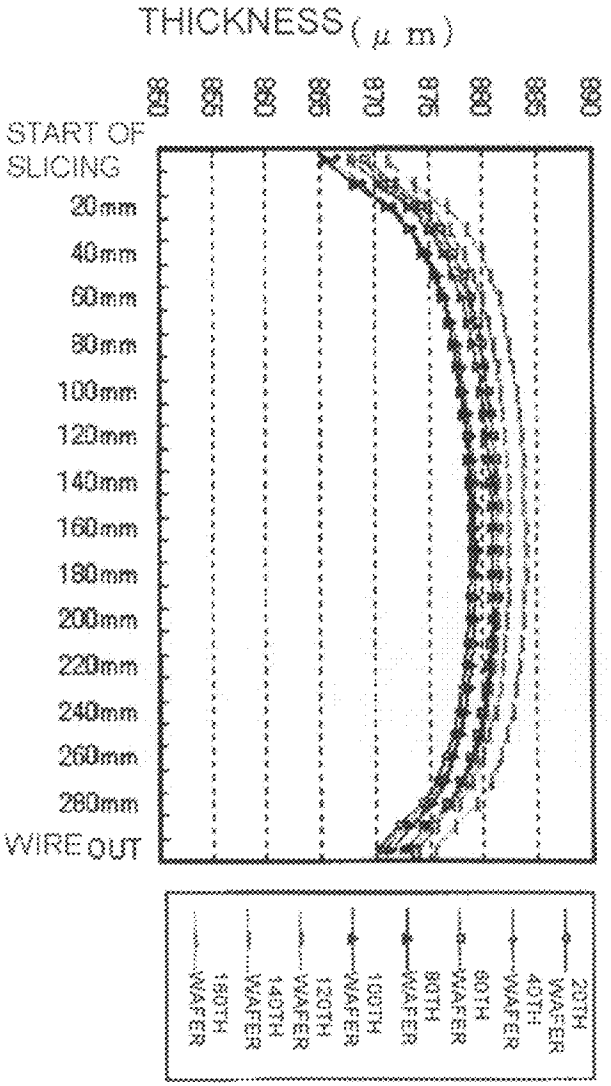
FIG. 4 is a graph showing a thickness distribution of a sliced wafer in Example.

Additionally, thickness distributions of the sliced wafers obtained in Example were measured. FIG. 4 shows measurement results of the sliced wafers, which are 20th, 40th, 60th, 80th, 100th, 120th, 140th, and 160th from a head side of the ingot as representatives.

It can be understood that a uniform thickness distribution can be obtained in, especially, the central region in any sample in this manner. Like later-explained Comparative Example 2, when the slurry for adjusting an ingot temperature is supplied from start of slicing, such a uniform thickness distribution cannot be obtained.

Further, pseudo nano-topographies were examined in sliced wafers obtained by slicing a plurality of ingots based on the same method as Example, and results depicted in FIG. 5(A) were obtained. FIG. 5 shows a level of each pseudo nano-topography in the period close to end of slicing with an abscissa representing a position of the ingot in an axial direction. In this manner, the level does not exceed an upper limit value (0.6 as a relative value) in any region of each ingot, an average value in each region of the ingot is 0.27 at a front end portion, 0.14 at a central portion, and 0.21 at a rear end portion, and it can be understood that the average value can be suppressed to a very small value.

The slicing method according to the present invention can suppress the nano-topography to a very small value in this manner, and high-quality wafers having a uniform thickness distribution were able to be obtained. When such a wafer is provided, a yield in a device process can be increased.

Comparative Example 1

A silicon ingot having a diameter of 300 mm and an axial length of 250 mm was prepared, and the silicon ingot was sliced in the same manner as Example except that the slurry for adjusting an ingot temperature was not supplied, thereby 240 wafers were obtained.

As shown in FIG. 3, in relation to a temperature of the ingot during slicing, it can be understood that the ingot is rapidly cooled at a position near a slicing end portion (275 mm to 300 mm).

Further, as shown in FIG. 5(B), in obtained sliced wafers, a level of a pseudo nano-topography is high. An average is 0.54 at a front end portion of the ingot, 0.33 at a central portion of the same, or 0.53 at a rear end portion of the same, and the average value is double the data of Example depicted in FIG. 5(A). In particular, the level exceeded an upper limit value 0.6 at a position near the slicing end portion of the wafer sliced out from the front end portion or the rear end portion of the ingot in some cases.

The wafer having such a level of the nana-topography greatly affects a yield in a device manufacturing process.

Comparative Example 2

The same silicon ingot as that in Example was sliced in the same manner as Example except that supply of the slurry for adjusting an ingot temperature began from start of slicing. It is to be noted a supply temperature profile of the slurry for adjusting an ingot temperature was the same as a supply temperature profile of a slurry for slicing (see FIG. 2(A)).

As a result, rapid cooling of the ingot near end of slicing was able to be avoided but, when a thickness distribution of each sliced wafer obtained by slicing was measured, a thickness in a central region considerably fluctuated like the case depicted in FIG. 16.

In this manner, according to the slicing method of the present invention, a cooling speed for the ingot when a slicing depth is equal to or above ⅔ of a diameter can be restricted, rapid cooling of the ingot in the time close to end of slicing in particular can be alleviated as shown in FIG. 3, a precipitous change in shape in sliced wafers obtained from slicing can be eliminated, a nano-topography can be improved, and each sliced wafer having a uniform thickness distribution can be obtained without largely fluctuating a thickness in a wafer central region as shown in FIG. 4. Therefore, high-quality wafers can be provided to the next process, thus a yield can be improved.

It is to be noted that the present invention is not restricted to the foregoing embodiment. The embodiment is just an exemplification, and any examples that have substantially the same feature and demonstrate the same functions and effects as those in the technical concept described in claims of the present invention are included in the technical scope of the present invention.

The invention claimed is:

1. A slicing method comprising winding a wire around a plurality of grooved rollers and pressing the wire against an ingot to be sliced into wafers while supplying a slurry for slicing to the grooved rollers and causing the wire to travel, wherein a cooling speed of the ingot when a slicing depth is equal to or above ⅔ of a diameter is controlled to perform slicing by supplying a slurry for adjusting an ingot temperature to the ingot independently from the slurry for slicing while controlling a supply temperature only in a period from the moment that the slicing depth of the ingot reaches at least ⅔ of the diameter to end of slicing.

2. The slicing method according to claim 1, wherein supply of the slurry for adjusting an ingot temperature is started at a temperature of the ingot when the slicing depth reaches at least ⅔ of the diameter, and then the slurry for adjusting an ingot temperature is supplied while gradually reducing a supply temperature thereof.

3. The slicing method according to claim 2, wherein the supply temperature of the slurry for adjusting an ingot temperature is reduced to be equal to a supply temperature of the slurry for slicing at end of slicing.

* * * * *